United States Patent [19]

Salsgiver et al.

[11] Patent Number: 4,780,155

[45] Date of Patent: Oct. 25, 1988

[54] CAPACITIVE ELECTRICAL DISCHARGE SCRIBING FOR IMPROVING CORE LOSS OF GRAIN-ORIENTED SILICON STEEL

[75] Inventors: James A. Salsgiver, Sarver; Eugene W. Bartel, Robinson Township, Allegheny County; Rowland C. Rudolf, III, Ben Avon, all of Pa.

[73] Assignee: Allegheny Ludlum Corporation, Pittsburgh, Pa.

[21] Appl. No.: 47,964

[22] Filed: May 8, 1987

[51] Int. Cl.[4] ..... H01F 1/04

[52] U.S. Cl. ..... 148/111; 148/113; 219/121.35

[58] Field of Search ..... 148/111, 112, 113; 219/121 R, 121 EB, 121 EG, 121 EM

[56] References Cited

U.S. PATENT DOCUMENTS 3,990,923 11/1976 Takashina et al. ..... 148/111

4,652,316 4/1987 Beckley ..... 148/112

FOREIGN PATENT DOCUMENTS 0137747 4/1985 European Pat. Off. .

OTHER PUBLICATIONS

"Further Prospects for Grain-Oriented Silicon Steels," J. A. Salsgiver, *Journal of Metals*, vol. 38, No. 1, Jan. 1986, pp. 27-31.

*Primary Examiner*—John P. Sheehan

*Attorney, Agent, or Firm*—Patrick J. Viccaro

[57] ABSTRACT

A method and apparatus are provided for domain refinement of texture annealed and insulation coated grain-oriented silicon steel strip by contacting the insulated steel surface to be scribed with a discharge electrode, moving the electrode substantially transverse to the rolling directioln while essentially maintaining contact, and marking the steel with a plurality of electrical discharge craters generally aligned across the steel by producing a plurality of electrical discharges between the electrode and steel from a capacitor of 0.001-10.0 microfarads.

6 Claims, 3 Drawing Sheets

@ 1.5KG
@ 1.7KG
⊙ 5.0 mfd. CAPACITOR
X 0.5 mfd. CAPACITOR
IMPROVEMENT IN CORE LOSS (%)
OHMS
10
20
30
40
0
300
600
900
1200

CAPACITIVE ELECTRICAL DISCHARGE SCRIBING FOR IMPROVING CORE LOSS OF GRAIN-ORIENTED SILICON STEEL

BACKGROUND OF THE INVENTION

This invention relates to a method for working the surface of grain-oriented silicon steel to affect the domain size so as to reduce core loss. More particularly, this invention relates to providing localized strains and defects on the surface of grain-oriented silicon steel by capacitive electrical discharge.

In the manufacture of grain-oriented silicon steel, it is known that the Goss secondary recrystallization texture, (110)[001], in terms of Miller's indices, results in improved magnetic properties, particularly permeability and core loss over nonoriented steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities, such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation. Grain-oriented silicon steel is typically used in electrical applications, such as power transformers, distribution transformers, generators, and the like. The domain structure and resistivity of the steel in electrical applications permits cyclic variation of the applied magnetic field with limited energy loss, which is termed "core loss". It is desirable, therefore, in steels of this type to reduce domain wall spacing and thereby the core loss, as described in *Journal of Metals,* Vol. 38, No. 1, January 1986, pp. 27–31.

It is known that domain size and thereby core loss values of grain-oriented silicon steels may be reduced if the steel is subjected to any of various practices to induce localized strains in the surface of the steel. Such practices may be generally referred to as "scribing" or "domain refining" and are performed after the final high temperature annealing operation.

If the steel is scribed after the decarburization anneal but prior to the final high temperature texture anneal, then the scribing generally controls the growth of the secondary grains to preclude formation of large grains and so tends to reduce the domain sizes. U.S. Pat. No. 3,990,923, issued Nov. 9, 1976, discloses methods wherein prior to the final high temperature annealing, a part of the surface is worked, such as by mechanical plastic working, local thermal treatment, or chemical treatment.

If the steel is scribed after final texture annealing, then there is induced a localized stress state in the texture annealed sheet so that the domain wall spacing is reduced. These disturbances typically are relatively narrow, straight lines, or scribes generally spaced at regular intervals. These scribe lines are typically transverse to the rolling direction and are typically applied to only one side of the steel.

There have been attempts to refine domain spacing and improve the magnetic properties of steel after final texture annealing by subjecting the steel sheet surface to an electrical discharge from a probe located above the surface of the sheet to create a line of surface ablation and stress. European patent application No. 137747A, published Apr. 17, 1985, discloses a method and apparatus including an electrical discharge probe adapted to be located above the surface of the grain-oriented sheet at a gap of up to 3 millimeters. A high voltage supply having a negative polarity on the order of 12 kilovolts is used to provide a voltage for discharge on the order of 3–10 kilovolts. Such high voltage was found necessary for the spark to traverse the air gap between the probe and the steel sheet and break down the insulating coating on the steel. The reference disclosed a circuit which included a capacitor for regulating the energy delivered to the sheet. Moving the probe above and across the sheet will produce a line of ablation spots. In the alternative, a continuous arc discharge could be produced so that a continuous line of ablation is formed. The discharge spots are disclosed in the alternative as being provided by a fixed power supply by use of a trigger mechanism to discharge the capacitor. See also U.S. Pat. No. 4,652,316, issued Mar. 24, 1987.

In the use of such grain-oriented silicon steels during fabrication incident to the production of transformers, for example, the steel is cut and subjected to various bending and shaping operations which produce stresses in the steel. In such instances, it is necessary and conventional for manufacturers to stress relief anneal the product to relieve such stresses. During stress relief annealing, it has been found that the beneficial effect on core loss resulting from some scribing techniques, such as thermal scribing, are lost.

In a copending application, Ser. No. 047,967 entitled "Electrical Discharge Scribing for Improving Core Loss of Grain-Oriented Silicon Steel", filed May 8, 1987, of the same Assignee, the inventors describe a method and apparatus for electrical discharge scribing by producing a plurality of electrical discharges between a contacting electrode traversing the steel surface and the steel surface. The apparatus requires higher voltages and higher currents in an intricate electrical circuit for scribing base coated and finish coated steels in a high speed process.

What is needed is a method and apparatus for reducing the core loss values over that which exist in grain-oriented steels which are only final texture annealed, have base or stress coating thereon, and are not scribed. It is desirable that a method be developed for scribing such steel wherein the scribe lines required to improve the core loss values of the steel may be applied in a uniform and efficient manne to result in uniform and reproduceably low core loss values. A low cost scribing practice should be compatible with the conventional steps and equipment for producing such grain-oriented steels, and, furthermore, such improvements in core loss values should, preferably, survive stress relief annealing which are incident to the fabrication of such steels into end products.

SUMMARY OF THE INVENTION

In accordance with the present invention, a method is provided for improving the core loss of grain-oriented silicon steel sheet or strip after cold rolling to final gauge and texture annealing by contacting the steel with a discharge electrode on the steel surface to be scribed, moving the electrode along the steel surface in a direction substantially transverse to the rolling direction while essentially maintaining contact therewith and domain refining or scribing the coated steel surface by producing a plurality of electrical discharges between the electrode and the steel from capacitor means of about 0.001 to 10 microfarads as the electrode traverses the steel for forming a plurality of indentations or craters generally aligned across the steel surface.

An apparatus is also provided comprising an electric discharge electrode adapted to contact the surface of the steel and to be moved along the steel surface in a direction substantially transverse to the rolling direction while essentially maintaining contact therewith and capacitor means of about 0.1 to 10 microfarads for producing a plurality of electrical discharges between the moving electrode and the steel to form a plurality of generally aligned indentations or craters across the steel surface.

DETAILED DESCRIPTION OF THE PREFERRED EMBODIMENTS

Broadly, in accordance with the practice of the invention, the core loss of grain-oriented silicon steel which has been cold rolled to final gauge and final texture annealed is improved by scribing the steel in a direction substantially transverse to the rolling direction, with the scribing being accomplished by producing a plurality of electrical discharges between an electrode and the surface of a steel strip thereby producing a plurality of indentations or craters generally aligned across the steel strip to constitute the line of scribing or domain refining. The scribing of a scribe line may be effected by positioning an electrode adjacent and in contact with the surface of the steel strip and moving the electrode in a direction substantially transverse to the rolling direction. A voltage source is provided for supplying less than 1000 volts, and preferably between 50 to 600 volts, for each discharge.

Figure 1:
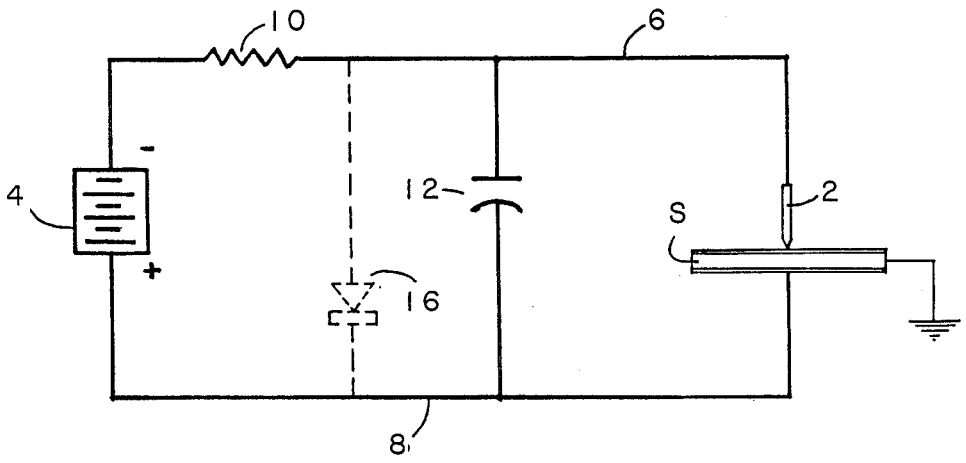
FIG. 1 is an electrical schematic of one embodiment of the apparatus of the present invention.
Figure 1A:
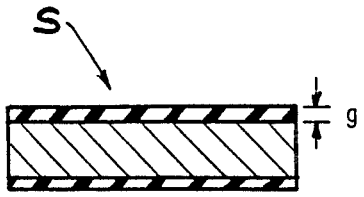
FIG. 1*a* is a cross section of insulation coated silicon steel used in the present invention.

FIG. 1 illustrates one embodiment of the present invention in the form of a capacitor discharge circuit. Coated silicon steel strip, S, is shown positioned beneath a discharge electrode 2 which is connected to resistor 10 and capacitor 12 through conductor 6. The silicon steel strip S is connected to the power supply 4 through conductor 8. A resistor 10 is interposed in series between power supply 4 and electrode 2. Capacitor 12 is also interposed in parallel with electrode 2 and the silicon steel strip S. A diode 16 may be interposed parallel to capacitor 12 to minimize voltage oscillation at the electrode or workpiece. The circuit shown in FIG. 1 functions to produce a defect in the surface of the silicon steel in the form of an indentation or crater by an electrical discharge from electrode 2 onto the surface of the steel strip. Voltage from the power supply 4 increases across the capacitor 12, which is initially discharged, until the voltage both across the capacitor and across the insulative coating forming gap "g" between the electrode and the steel strip is sufficient to break down or ionize the coating shown in FIG. 1*a*. In view of different insulative coatings and thicknesses, gap "g" may range from 500 to 50,000 Angstroms. The current then delivered from the capacitor through conductor 6 to the electrode 2 results in the discharge therefrom of an electrical spark or controlled discharge onto the steel surface.

Although the present invention described in detail hereafter has utility with grain-oriented silicon steel generally, the following typical compositions are two examples of silicon steel compositions adapted for use with the present invention and which were used in developing the present invention. The steel melts of two steels initially contained the nominal compositions of:

| Steel | C | N | Mn | S | Si | Cu | B | Fe |
|---|---|---|---|---|---|---|---|---|
| 1 | .030 | 50 ppm | .07 | .022 | 3.15 | .22 | — | Bal. |
| 2 | .030 | <50 ppm | .035 | .017 | 3.15 | .30 | 10 ppm | Bal. |

Unless otherwise noted, all composition ranges are in weight percentages.

Steel 1 is a conventional grain-oriented silicon steel and Steel 2 is a high permeability grain-oriented silicon steel. Both steels were produced by casting, hot rolling, normalizing, cold rolling to final gauge with an intermediate annealing when two or more cold rolling stages are made, decarburizing, coating with MgO and final texture annealing to achieve the desired secondary recrystallization of cube-on-edge orientation. After decarburizing the steel, a refractory oxide annealing separator coating containing primarily magnesium oxide was applied before final texture annealing at elevated temperature, such annealing causing a reaction at the steel surface to create a forsterite base coating. For some samples of the steel, a stress coating composition was applied to the grain-oriented silicon steel after final high temperature texture annealing. The stress coating is applied as a finish coating and places the steel in tension on cooling from the temperature at which it is cured. Such tension tends to decrease the core loss of the steel. Although the steel melts of Steels 1 and 2 initially contained the nominal compositions recited above, after final texture annealing, the C, N, and S were reduced to trace levels of less than about 0.001%, by weight.

Figure 2:
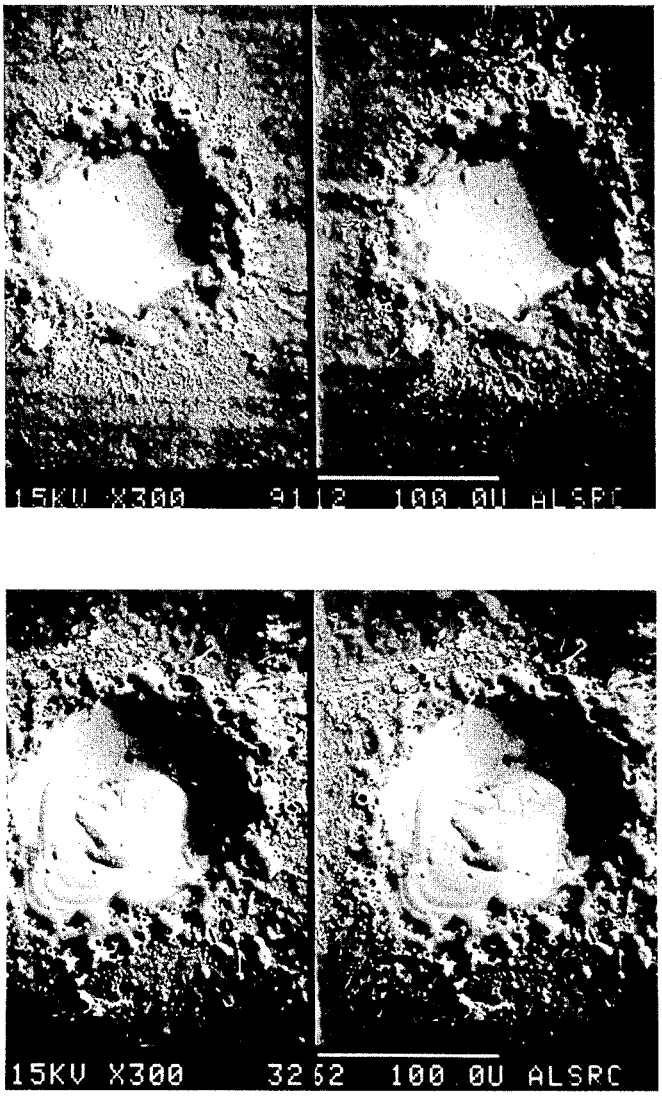
FIG. 2 is a set of SEM stereo pair photomicrographs of typical indentations or craters on as-scribed silicon steel in accordance with the present invention.

FIG. 2 is a set of Scanning Electron Microscope (SEM) stereo pair of photomicrographs of typical indentations or craters on strip surface of Steel No. 2 as scribed according to the electrical discharge scribing of the present invention. The craters or indentations have the effect of refining the domains of the grain-oriented silicon steel when a plurality of them are generally aligned across the steel surface. Each crater may be approximately 2 to 40 microns deep and may have a diameter of from 20 to 150 microns. In accordance with the present invention, the steel may be scribed by producing about 10 to 500 craters per inch generally aligned across the steel surface.

Electrode 2 may be any conventional electrode, preferably of the wire type. The electrode may be made of any of various conventional electrode materials such as tungsten, thoriated tungsten, tungsten carbide, copper or copper-beryllium. As electrode 2 is essentially in constant contact adjacent the coated steel surface, the electrodes should have sufficient high temperature resistance to survive long commercial scribing operations.

Although the term "contact" is used for describing the placement of the electrode relative to the steel strip, what is meant is that the electrode is in direct physical contact with the insulating coating of the steel surface or in contact with a plasma gas cloud that forms between the electrode and steel strip as the insulating coating ionizes during each electrical discharge. It has been found that while the electrode directly contacts the steel surface when the current is off, the electrode seems to ride a plasma gas cloud generated by the plurality of electrical discharges as the electrode traverses the steel strip.

The power supply or voltage source 4 is a relatively low voltage source of less than 1000 volts, preferably between 50 to 600 volts. Furthermore, it is preferred that the voltage source be a direct current, DC, source. It is important that the voltage be sufficiently large to break down the insulation on the coated steel surface.

Although electrode 2 may be connected to either the positive or negative side of the voltage source 4, it is preferred that the electrode be at the negative potential, not only to improve wear resistance, but also for reasons described hereafter, to provide improved core loss.

Resistor 10 may be any conventional low inductance resistor capable of providing a given resistance up to 10,000 ohms and preferably from 100 to 1300 ohms. The current provided by the circuit must be sufficient to provide an electrical discharge which can both break down the coating on the steel, and work the steel surface and cause defect in the steel surface as manifested by an indentation or crater. The current pulse is relatively high initially, perhaps several hundred amperes, and then exponentially decays to milliamperes once the capacitor is discharged. As the electrode moves to a new position away from the previous spark crater, no current flows through the electrode until a new breakdown event occurs.

Capacitor 12 is a relatively large capacitor having a capacitance of about 0.001 to 10.0 microfarads (mf), preferably, 0.5 to 5.0 mf. As is known, the energy delivered to the spark is on the order of one-half $CV^2$ joules where C is the capacitance of the capacitor and V is the voltage between the electrode and the steel sheet. For the voltage and current levels of the present invention, the capacitor must be properly selected so as to provide the necessary breakdown voltage and current for ionizing the coating on the steel.

One or more fast recovery diodes 16 may be used in the circuit to minimize or avoid any voltage oscillation in the circuit after discharge of the capacitor.

In order to better understand the present invention, the following examples are presented.

EXAMPLE 1

To illustrate the several aspects of the scribing process of the present invention, various samples of a silicon steel having the composition similar to Steel 1 and Steel 2 were processed as shown in Table I and the results of the tests are shown in the following Table II. Each sample was a 20-strip Epstein pack from which the magnetic properties were obtained. Each pack of Table I was obtained either from various mill heats of nominally 7-mil gauge silicon steel having the above-identified typical composition of Steel 1 or lab heats of nominally 8-mil gauge silicon steel having the typical composition of Steel 2. All of the strips were final texture annealed in a hydrogen atmosphere at a soak temperature of 2150° F. (1180° C) prior to scribing in accordance with the present invention. Some of the samples were stress coated after final texture annealing as indicated. Each of the 20 strips in the Epstein pack were scribed with each strip positioned parallel to each adjacent strip on a fixture for scribing. The scribing was done manually by moving an electrode substantially transverse to the rolling direction of the strip at the speeds indicated in Table I. The electrode was a thoriated tungsten wire electrode which was placed adjacent and in contact with the steel strip surfaces and moved in a direction substantially transverse to the rolling direction. Identations or craters were formed substantially aligned across the steel strip surface with a frequency of about 200 to 500 craters per inch. The circuitry was similar to that shown in FIG. 1 except the electrode 2 had a+polarity and was connected to the positive side of the voltage source 4 for supplying 175 volts, DC.

For comparison purposes, the magnetic properties of each pack prior to scribing (identified "as received"), as scribed, and after stress relief annealing are presented in Table II. Each sample pack having the composition of Steel 1 was stress relief annealed for two hours at 1475° F. (800° C.) in hydrogen. Each sample pack having the composition of Steel 2 was stress relief annealed for two hours at 1475° F. (800° C.) in a dry mixture of 85% nitrogen and 15% hydrogen.

Also for comparision purposes, sample Pack No. 51-0 having a composition of Steel 1 was mechanically scribed by using a sharpened tool steel scribe capable of scratching the base coating to form grooves about 5 mils (0.1 mm) wide to provide a plurality of score lines across the steel strip surfaces substantially transverse to the rolling direction having a spacing of about 6 mm. Pack No. 51-0 was base coated only.

TABLE I

| Pack No. | Capacitor (mf) | Resistance (Ohms) | Speed (in/min) | Spacing (mm) | Samples Composition | Gauge (mils) | Coating |
|---|---|---|---|---|---|---|---|
| 53-0 | 0.0015 | 1250 | 300 | 5 | Steel No. 1 | 7 | Base Coated |
| 50-0 | 0.5 | 1250 | 300 | 5 | Steel No. 1 | 7 | Base Coated |
| 60-0 | 0.5 | 1250 | 300 | 5 | Steel No. 1 | 7 | Base Coated |
| 59-0 | 5.0 | 600 | 50 | 5 | Steel No. 1 | 7 | Base Coated |
| 55-0 | 5.0 | 600 | 120 | 5 | Steel No. 1 | 7 | Base Coated |
| 54-0 | 5.0 | 600 | 300 | 5 | Steel No. 1 | 7 | Base Coated |
| 52-0 | 5.0 | 1250 | 300 | 5 | Steel No. 1 | 7 | Base Coated |

TABLE I-continued

| Pack No. | Capacitor (mf) | Resistance (Ohms) | Speed (in/min) | Spacing (mm) | Samples Composition | Gauge (mils) | Coating |
|---|---|---|---|---|---|---|---|
| 5 | 0.5 | 1250 | 120 | 10 | Steel No. 2 | 8 | Stress Coated |

TABLE II

| Pack No. | Condition | Core Loss mWPP @ 15 KB | @ 17 KB | Reduced Core Loss by Scribing (%) @ 15 KB | @ 17 KB | Permeability at 10 H | at 200 B | H at 200 B |
|---|---|---|---|---|---|---|---|---|
| 53-0 | as rec'd. | 423 | 635 | 2.6 | 2.2 | 1864 | 14490 | .0138 |
| | scribed | 412 | 621 | | | 1861 | 14925 | .0134 |
| | SRA | 417 | 632 | | | 1862 | 13420 | .0149 |
| 50.0 | as rec'd. | 425 | 644 | 8.5 | 9.3 | 1860 | 13990 | .0143 |
| | scribed | 389 | 584 | | | 1854 | 13605 | .0147 |
| | SRA | 425 | 642 | | | 1859 | 12740 | .0157 |
| 60-0 | as rec'd. | 426 | 644 | 4.9 | 4.3 | 1862 | 14180 | .0141 |
| | scribed | 405 | 616 | | | 1858 | 14810 | .0135 |
| | SRA | 419 | 636 | | | 1860 | 13420 | .0149 |
| 59-0 | as rec'd. | 421 | 632 | −2.4 | 7.2 | 1863 | 14810 | .0135 |
| | scribed | 431 | 618 | | | 1842 | 10204 | .0196 |
| | SRA | 413 | 628 | | | 1861 | 13330 | .0150 |
| 55-0 | as rec'd. | 422 | 635 | 6.9 | 8.2 | 1863 | 14493 | .0138 |
| | scribed | 393 | 583 | | | 1860 | 14085 | .0142 |
| | SRA | 411 | 623 | | | 1863 | 13610 | .0147 |
| 54-0 | as rec'd. | 422 | 628 | 4.7 | 3.2 | 1862 | 14390 | .0139 |
| | scribed | 402 | 608 | | | 1859 | 15152 | .0132 |
| | SRA | 414 | 625 | | | 1861 | 13610 | .0147 |
| 52-0 | as rec'd. | 423 | 636 | 3.8 | 3.1 | 1862 | 14180 | .0141 |
| | scribed | 407 | 616 | | | 1861 | 14706 | .0136 |
| | SRA | 413 | 626 | | | 1862 | 13330 | .0150 |
| 5 | as rec'd. | 415 | 563 | 9.6 | 8.3 | 1908 | 11980 | .0167 |
| | scribed | 375 | 516 | | | 1904 | 12120 | .0165 |
| | SRA | 418 | 567 | | | 1970 | 11050 | .0181 |
| 51-0 | as rec'd. | 423 | 636 | 9.2 | 9.4 | 1863 | 14390 | .0139 |
| (Comparison) | scribed | 384 | 573 | | | 1855 | 13990 | .0143 |
| | SRA | 417 | 631 | | | 1862 | 14180 | .0141 |

Under the experimental conditions described above for the circuit parameters, scribing and speed and spacing, the Table shows the effects of such scribing on the magnetic properties of grain-oriented strip, both as scribed and after stress relief annealing (SRA). In the as-scribed condition, Pack No. 50-0 shows excellent core loss reductions at 1.7T (17 KB) of up to 9.3%. That core loss reduction compares favorably to that measured on the mechanically scribed control Pack No 51-0 showing core loss reductions of up to 9.4% at 1.7T. The data of Table II, however, does show that some improvements in core loss values are able to survive stress relief annealing. For example, Pack No. 55-0 shows retention of about 1.9% core loss benefits at 1.7T (17 KB) after SRA. Pack No. 52-0 shows retention of about 1.6% core loss benefits at 1.7T (17 KB) after SRA. In view of such results, is it expected that process parameter changes, such as larger capacitors, could result in even better survival of stress relief annealing and produce a desirable heat resistant domain refining process.

EXAMPLE 2

By the way of further examples, additional tests were performed to demonstrate the effect of scribing speed and polarity of the electrode. All of the sample packs of Table III were obtained from various heats of nominally 7-mil gauge silicon steel having the typical composition of Steel 1 having a base coating thereon. Each sample pack was prepared in a manner similar to that in Example 1 under the experimental conditions described in Table III. All of the scribing was done at 175 volts DC with a capacitor of 5.0 mf and the results are shown in Table IV.

TABLE III

| Pack No. | Resistance Ohms | Speed in/min | Spacing mm | Electrode Polarity | Di-electric |
|---|---|---|---|---|---|
| 58-0 | 300 | 50 | 5 | + | Air |
| 63-0 | 300 | 50 | 5 | − | Air |
| 57-0 | 300 | 120 | 5 | + | Air |
| 61-0 | 300 | 120 | 5 | − | Air |
| 56-0 | 300 | 300 | 5 | + | Air |
| SS 62-0-1 | 300 | Points 1/16" apart | 5 | + | Air |
| 64-0 | 600 | 120 | 5 | + | ½" Kerosene |

TABLE IV

| Pack No. | Condition | Core Loss (mWPP) 15 KB | 17 KB | Reduced Core Loss by Scribing (%) @ 15 KB | @ 17 KB | Permeability at 10 H | at 200 B | H at 200 B |
|---|---|---|---|---|---|---|---|---|
| 58-0 | As rec'd. | 424 | 639 | −22.9 | −14.7 | 1860 | 14180 | .0141 |
| | scribed | 521 | 723 | | | 1817 | 6780 | .0245 |
| | SRA | 419 | 645 | | | 1857 | 12500 | .0160 |
| 63-0 | As rec'd. | 426 | 639 | −35.2 | −22.7 | 1864 | 14180 | .0141 |
| | scribed | 576 | 784 | | | 1792 | 5390 | .0371 |
| | SRA | 411 | 631 | | | 1861 | 12820 | .0156 |
| 57-0 | As rec'd. | 417 | 625 | 2.9 | 5.3 | 1866 | 14080 | .0142 |

TABLE IV-continued

| Pack No. | Condition | Core Loss (mWPP) 15 KB | 17 KB | Reduced Core Loss by Scribing (%) @ 15 KB | @ 17 KB | Permeability at 10 H | at 200 B | H at 200 B |
|---|---|---|---|---|---|---|---|---|
| | Scribed | 405 | 592 | | | 1854 | 11900 | .0168 |
| | SRA | 417 | 631 | | | 1863 | 13070 | .0153 |
| 61-0 | As rec'd. | 427 | 637 | −3.3 | 0.5 | 1864 | 14390 | .0139 |
| | scribed | 441 | 634 | | | 1840 | 9430 | .0212 |
| | SRA | 422 | 644 | | | 1861 | 13990 | .0143 |
| 56-0 | As rec'd. | 434 | 659 | 7.1 | 6.4 | 1856 | 13890 | .0144 |
| | scribed | 403 | 617 | | | 1855 | 14600 | .0137 |
| | SRA | 426 | 648 | | | 1857 | 12990 | .0154 |
| (Single strip) | As rec'd. | 452 | 731 | −3.1 | 6.4 | 1836 | — | — |
| SS 62-0-1 | scribed | 466 | 684 | | | 1811 | — | — |
| | SRA | 452 | 726 | | | 1835 | — | — |
| 64-0 | As rec'd. | 423 | 638 | 8.3 | 9.1 | 1862 | 14180 | .0141 |
| | scribed | 388 | 580 | | | 1856 | 13070 | .0153 |
| | SRA | 434 | 662 | | | 1857 | 14080 | .0142 |

Samples 58-0, 63-0, 57-0, 61-0, and 56-0 were scribed at varying speeds from 50 to 300 inches per minute (IPM). At the slowest speed of 50 IPM, the core losses at 1.7T were increased by up to 22.7%, regardless of polarity. Sample 56-0 exhibited a plurality of craters generally aligned across the strip at about 100 craters per inch.

Samples 63-0 and 61-0 were conducted at a reversed polarity, i.e., having the tungsten electrode at a negative potential. In comparison to the counterparts, Samples 58-0 and 57-0, respectively, it seems that changing to negative electrode polarity increases the scribing effect in a similar manner as does the decrease in scribing speed. It was also observed that the tungsten electrode underwent considerably less erosion under the negative potential.

Sample 64-0 was tested for the purpose of determining whether or not more severe stress gradients could be created in the steel surface by discharging through various dielectrics, such a kerosene. Although some of the scribe lines were not equally spaced and tended to overlap due to the manner of scribing, the core losses at 1.7T were reduced 9.1%. All of the samples were scribed using a capacitor of 5.0 mf and a resistor of 300 ohms except for sample 64-0. All of the samples were stress relief annealed in a manner similar to Example 1. Examination under scanning electron microscope of sample 64-D scribed in the kerosene dielectric shows that there is smaller surface area affected and a smaller crater size created with a reduction in the deposition of debris on the crater edges than when scribing in air.

Other liquid dielectrics may also be suitable for controlling the electrical discharge and the debris about the crater edges. A liquid dielectric may be selected from the group consisting of kerosene, mixed hydrocarbons, polyglycols, petroleum hydrocarbons, silicones, and mixtures thereof.

EXAMPLE 3

By way of further examples, additional tests were performed to demonstrate the effect of negative polarity and increased resistance at various scribing speeds. All of the sample packs of Table V were obtained from various heats of nominally 7-mil base coated gauge silicon steel having typically the composition of Steel 1. All of the data tend to show improvements in core loss in the as-scribed condition and some retained benefits in improved core loss after the stress relief anneal. All of the scribing was done at 175 volts DC with only air as a dielectric and the results are shown in Table VI. Each pack was prepared in a manner similar to those in Example 1.

The data of Table VI demonstrate that large core loss improvements are obtainable with a negative bias on the electrode. For example, Pack Nos. 47-0 and 44-0 have 1.7T core loss improvements of 10.5% and 11.4%, respectively. Pack No. 46-0 has a 3% heat resistant core loss improvement at 1.7T (17 KB) as a result of the scribing process. Samples 44-0, 46-0, and 47-0 each exhibited a plurality of craters generally aligned cross the strip at about 333, 92, and 400 craters per inch, respectively.

Table VII is a comparison of results of Epstein packs which were scribed under the same conditions except for the electrode polarity. The comparison shows that the negative polarity of the electrode helps in obtaining maximum core loss improvement. Sample 68-0 exhibited a plurality of craters generally aligned across the strip at about 292 craters per inch.

TABLE V

| Pack No. | Capacitor (mf) | Resistance Ohms | Speed in/min | Spacing mm | Electrode Polarity |
|---|---|---|---|---|---|
| 47-0 | 0.5 | 1250 | 50 | 5 | − |
| 44-0 | 0.5 | 1250 | 120 | 5 | − |
| 43-0 | 0.5 | 1250 | 300 | 5 | − |
| 48-0 | 5.0 | 600 | 50 | 5 | − |
| 45-0 | 5.0 | 600 | 120 | 5 | − |
| 46-0 | 5.0 | 600 | 300 | 5 | − |

TABLE VI

| Pack No. | Condition | Core Loss mWPP @ 15 KB | @ 17 KB | Reduced Core Loss by Scribing (%) @ 15 KB | @ 17 KB | Permeability at 10 H | at 200 B | H at 200 B |
|---|---|---|---|---|---|---|---|---|
| 47-0 | As rec'd. | 424 | 637 | 7.5 | 10.5 | 1865 | 14080 | .0142 |
| | scribed | 392 | 570 | | | 1855 | 11560 | .0173 |
| | SRA | 419 | 629 | | | 1867 | 14180 | .0141 |
| 44-0 | As rec'd. | 426 | 641 | 10.8 | 11.4 | 1861 | 14080 | .0142 |
| | scribed | 380 | 568 | | | 1857 | 13700 | .0146 |
| | SRA | 422 | 635 | | | 1861 | 14180 | .0141 |

TABLE VI-continued

| Pack No. | Condition | Core Loss mWPP @ 15 KB | Core Loss mWPP @ 17 KB | Reduced Core Loss by Scribing (%) @ 15 KB | Reduced Core Loss by Scribing (%) @ 17 KB | Permeability at 10 H | Permeability at 200 B | H at 200 B |
|---|---|---|---|---|---|---|---|---|
| 43-0 | As rec'd. | 429 | 646 | 6.5 | 5.4 | 1863 | 13790 | .0145 |
| | scribed | 401 | 611 | | | 1861 | 14710 | .0136 |
| | SRA | 421 | 636 | | | 1864 | 13790 | .0145 |
| 48-0 | As rec'd. | 433 | 642 | 1.4 | 5.1 | 1867 | 14180 | .0141 |
| | scribed | 427 | 609 | | | 1844 | 9350 | .0214 |
| | SRA | 419 | 633 | | | 1865 | 14290 | .0140 |
| 45.0 | As rec'd. | 431 | 656 | 3.7 | 7.5 | 1856 | 13700 | .0146 |
| | scribed | 415 | 607 | | | 1840 | 10260 | .0195 |
| | SRA | 427 | 657 | | | 1854 | 13070 | .0153 |
| 46-0 | As rec'd. | 426 | 642 | 8.2 | 8.4 | 1865 | 13890 | .0144 |
| | scribed | 391 | 588 | | | 1866 | 14710 | .0136 |
| | SRA | 415 | 623 | | | 1867 | 13990 | .0143 |

TABLE VII

| Pack No. | Condition | Core Loss (mWPP) @ 17 KG | Core Loss Improvement (%) | Electrode Polarity | Capacitor (mf) | Resistance (ohms) | Scribing Speed (in/min) |
|---|---|---|---|---|---|---|---|
| 57-I | As rec'd. | 629 | 8.6 | + | 0.5 | 1250 | 50 |
| | Scribed | 575 | | | | | |
| 49-0 | As rec'd. | 636 | 9.4 | − | 0.5 | 1250 | 50 |
| | Scribed | 576 | | | | | |
| 41-0 | As rec'd. | 636 | 11.0 | + | 0.5 | 1250 | 120 |
| | Scribed | 566 | | | | | |
| 68-0 | As rec'd. | 659 | 12.9 | − | 0.5 | 1250 | 120 |
| | Scribed | 574 | | | | | |
| 60-I | As rec'd. | 626 | 3.2 | + | 0.5 | 1250 | 300 |
| | Scribed | 606 | | | | | |
| 66-0 | As rec'd. | 644 | 4.8 | − | 0.5 | 1250 | 300 |
| | Scribed | 613 | | | | | |
| 64-I | As rec'd. | 632 | 6.3 | + | 5.0 | 600 | 50 |
| | Scribed | 592 | | | | | |
| 35-0 | As rec'd. | 644 | 0.9 | − | 5.0 | 600 | 50 |
| | Scribed | 638 | | | | | |
| 59-I | As rec'd. | 639 | 8.9 | + | 5.0 | 600 | 120 |
| | Scribed | 582 | | | | | |
| 36-0 | As rec'd. | 640 | 9.1 | − | 5.0 | 600 | 120 |
| | Scribed | 582 | | | | | |
| 65-I | As rec'd. | 627 | 3.7 | + | 5.0 | 600 | 300 |
| | Scribed | 604 | | | | | |
| 65-0 | As rec'd. | 642 | 9.2 | − | 5.0 | 600 | 300 |
| | Scribed | 588 | | | | | |

EXAMPLE 4

Additional tests were performed to determine effects in varying the scribing parameters, partcularly the resistance voltage and current. All of the sample packs of Table VIII were obtained from various heats of nominally 7-mil gauge silicon steel having the typical composition of Steel 1 having a base coating. The results of Table VIII indicate that too low a voltage or resistance permits a sustained high sparking discharge that damages or degrades the magnetics. From FIG. 3 and Table VIII, the minimum resistance might be deduced to be between 20 and 150 ohms. Low voltage and low resistance (high continuous currents) are welding-like parameters that do not work for this purpose.

TABLE VIII

| Pack No. | V Volts | R Ohms | Speed in/min | Current Amps | Condition | Core Loss (mWPP) 15 KB | Core Loss (mWPP) 17 KB | Reduced Core Loss by Scribing (%) @ 15 KB | Reduced Core Loss by Scribing (%) @ 17 KB | Permeability at 10 H | Permeability at 200 B | H at 200 B |
|---|---|---|---|---|---|---|---|---|---|---|---|---|
| 38I | 70 | 20 | 300 | 10* | As rec'd. | 421 | 637 | −6.9 | −1.7 | 1851 | 14080 | .0142 |
| | | | | | Scribed | 450 | 640 | | | 1835 | 8700 | .0230 |
| | | | | | SRA | | | | | | | |
| 39I | 70 | 20 | 300 | 3* | As rec'd. | 421 | 630 | −5.0 | 0 | 1862 | 14930 | .0134 |
| | | | | | Scribed | 442 | 631 | | | 1844 | 8810 | .0227 |
| | | | | | SRA | | | | | | | |
| 37I | 70 | 1250 | 300 | nil* | As rec'd. | 415 | 628 | +2.2 | +2.4 | 1858 | 14810 | .0135 |
| | | | | | Scribed | 406 | 613 | | | 1858 | 14810 | .0135 |
| | | | | | SRA | | | | | | | |
| 36I | 70 | 1250 | 120 | nil* | As rec'd. | 418 | 633 | +5.7 | +5.4 | 1856 | 14710 | .0136 |
| | | | | | Scribed | 394 | 599 | | | 1856 | 15270 | .0131 |
| | | | | | SRA | | | | | | | |
| 49I | 60 | 20 | 300 | 3** | As rec'd. | 416 | 632 | +11.3 | −4.6 | 1854 | 14930 | .0134 |
| | | | | | Scribed | 463 | 661 | | | 1835 | 8550 | .0234 |
| | | | | | SRA | | | | | | | |
| 35I | 175 | 1250 | 120 | 0.14** | As rec'd. | 432 | 656 | +9.7 | +9.3 | 1848 | 14180 | .0141 |
| | | | | | Scribed | 390 | 595 | | | 1846 | 14290 | .0140 |

TABLE VIII-continued

| Pack No. | V Volts | R Ohms | Speed in/min | Current Amps | Condition | Core Loss (mWPP) 15 KB | Core Loss (mWPP) 17 KB | Reduced Core Loss by Scribing (%) @ 15 KB | Reduced Core Loss by Scribing (%) @ 17 KB | Permeability at 10 H | Permeability at 200 B | H at 200 B |
|---|---|---|---|---|---|---|---|---|---|---|---|---|
| | | | | | SRA | | | | | | | |

*Meter Reading
**Calculated

EXAMPLE 5

Figure 3:
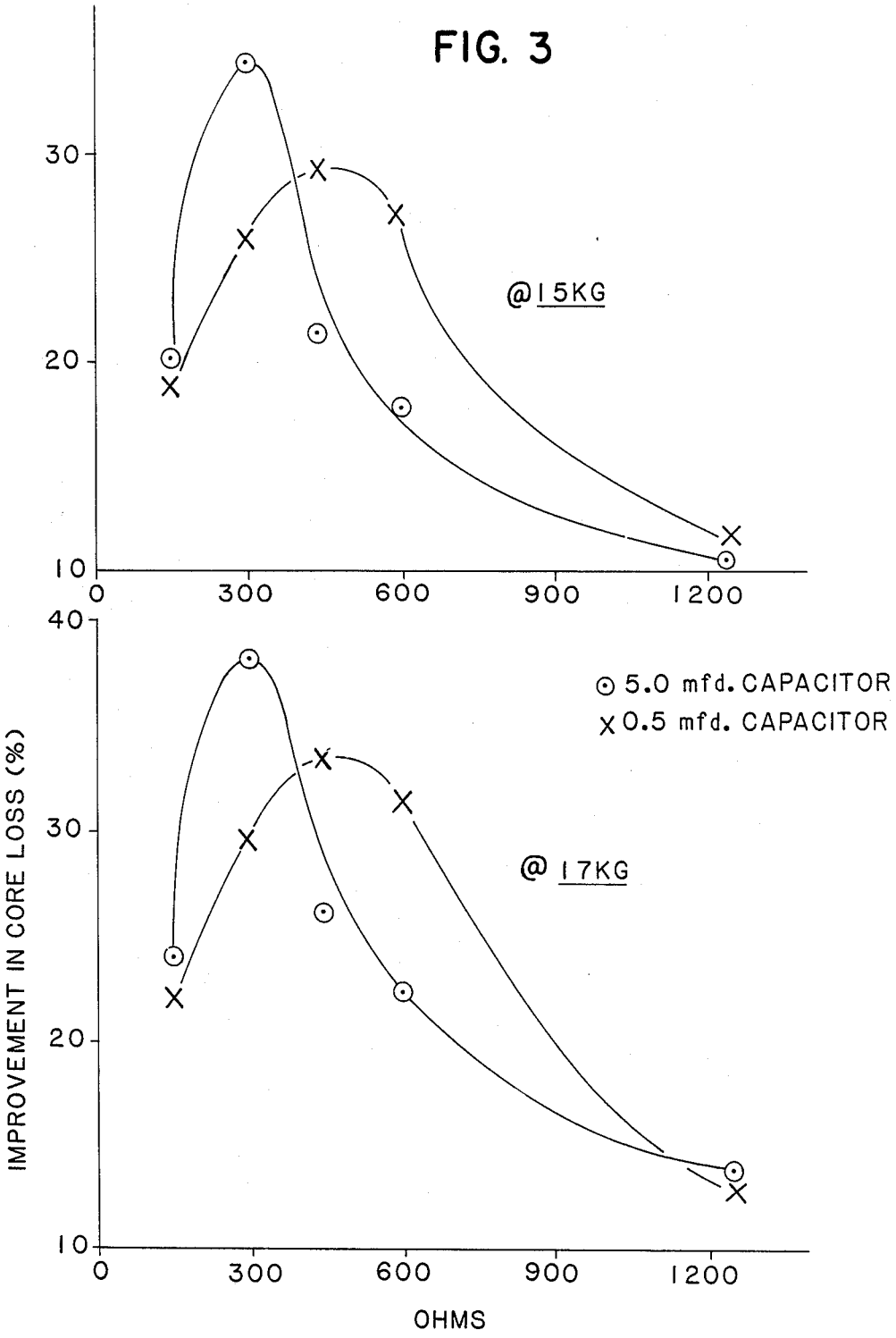
FIG. 3 is a set of graphs illustrating the percentage improvement in core loss values provided in accordance with the present invention.

Additional Epstein packs were prepared from scribed steel strip from various heats of nominally 9-mil gauge silicon steel having the typical composition of Steel No. 2 having a base coating thereon. The steel was laboratory processed from mill hot-rolled band. All scribing was done at 175 DC volts in air as a dielectric to form scribe lines about 5 mm apart, at 300 IPM at different resistance values up to 1250 ohms. The percentage core loss improvement is shown in FIG. 3 at 15 KG and 17 KG at two capacitor levels of 0.5 and 5.0 mf. The data show that the as-scribed steel exhibits improved core loss values over the resistance range up to 1250 ohms resistance, and greater than 20% improvement for values of 100–700 ohms.

As was an object of the present invention, method and apparatus have been developed using capacitive discharge for scribing silicon steel to improve the core loss. The scribing method has the capability of providing improvements in core loss values which may survive stress relief annealing.

Although preferred and alternative embodiments have bee described, it will be apparent to one skilled in the art that changes can be made therein without departing from the scope of the invention.

What is claimed is:

1. A method for improving the core loss by domain space refinement of texture annealed and insulation coated grain-oriented silicon steel sheet or strip, said method comprising:

contacting the insulated steel surface to be scribed with a discharge electrode;

providing a voltage source for supplying between 50 to 1000 volts for each of a plurality of electrical discharges;

moving the electrode along the insulated steel surface in a direction substantially transverse to the rolling direction while essentially maintaining contact therewith; and marking the steel surface with a plurality of discharge craters generally aligned across the steel surface by producing the plurality of electrical discharges between the electrode and the steel from capacitor means of about 0.001 to 10 microfarads as the electrode traverses the steel to reduce the core loss thereof.

2. The method of claim 1 including maintaining the electrode with a negative potential relative to the steel.

3. The method of claim 1 including applying a liquid dielectric to the coating steel surface to be scribed.

4. The method of claim 3 wherein the liquid dielectric is selected from the group consisting of kerosene, polyglycols, mixed hydrocarbons, silicones, and mixtures thereof.

5. The method of claim 1 wherein the capacitance of the capacitor is about 0.5 to 5.0 microfarads.

6. The method of claim 1 wherein scribing the steel by producing about 10 to 500 craters per inch generally aligned across the steel surface.

* * * * *